US006391509B1

(12) United States Patent
Drappel et al.

(10) Patent No.: US 6,391,509 B1
(45) Date of Patent: May 21, 2002

(54) COATED CARRIERS

(75) Inventors: Stephan V. Drappel, Toronto; George Liebermann; Richard P. N. Veregin, both of Mississauga; Thomas E. Enright, Bradford, all of (CA); Scott M. Silence, Fairport; Michael J. Duggan, Webster, both of NY (US); Paula J. MacLeod, Etobicoke (CA)

(73) Assignee: Xerox Corporation, Stamford, CT (US)

( * ) Notice: Subject to any disclaimer, the term of this patent is extended or adjusted under 35 U.S.C. 154(b) by 83 days.

(21) Appl. No.: 09/640,601

(22) Filed: Aug. 17, 2000

(51) Int. Cl.[7] ..... G03G 9/083

(52) U.S. Cl. ..... 430/111.35; 430/111.4; 430/111.41; 430/137.13

(58) Field of Search ..... 430/106.6, 108, 430/137, 111.35, 111.4, 111.41, 137.13

(56) References Cited

U.S. PATENT DOCUMENTS

| | | | | |
|---|---|---|---|---|
| 3,533,835 | A | 10/1970 | Hagenbach et al. | 430/111 |
| 3,590,000 | A | 6/1971 | Palermiti | 430/110 |
| 3,658,500 | A | 4/1972 | Hagenbach | 65/21.3 |
| 3,798,167 | A | 3/1974 | Kukla et al. | 435/109 |
| 3,918,968 | A | 11/1975 | Kukla et al. | 430/31 |
| 3,922,382 | A | 11/1975 | Kukla et al. | 430/137 |
| 3,939,086 | A | 2/1976 | Hagenbach | 430/108 |
| 4,233,387 | A | 11/1980 | Mammino et al. | 430/137 |
| 4,238,558 | A | 12/1980 | Ziolo | 430/108 |
| 4,264,697 | A | 4/1981 | Perez et al. | 430/107 |
| 4,298,672 | A | 11/1981 | Lu | 430/108 |
| 4,310,611 | A | 1/1982 | Miskinis | 430/107 |
| 4,338,390 | A | 7/1982 | Lu | 430/106 |
| 4,368,970 | A | 1/1983 | Hays | 430/122 |
| 4,394,429 | A | 7/1983 | Hays | 430/102 |
| 4,397,935 | A | 8/1983 | Ciccarelli et al. | 430/110 |
| 4,434,220 | A | 2/1984 | Abbott et al. | 430/108 |
| 4,546,060 | A | 10/1985 | Miskinis et al. | 430/108 |
| 4,584,253 | A | 4/1986 | Lin et al. | 430/58.4 |
| 4,764,445 | A | 8/1988 | Miskinis et al. | 430/108 |
| 4,798,685 | A | 1/1989 | Yaniger | 252/500 |
| 4,855,205 | A | 8/1989 | Saha et al. | 430/106.6 |
| 4,855,206 | A | 8/1989 | Saha | 430/106.6 |
| 4,937,166 | A | 6/1990 | Creatura et al. | 430/108 |
| 5,002,846 | A | 3/1991 | Creatura et al. | 430/108 |
| 5,015,550 | A | 5/1991 | Creatura et al. | 430/108 |
| 5,069,820 | A | 12/1991 | Jen et al. | 252/500 |
| 5,227,460 | A | 7/1993 | Mahabadi et al. | 528/272 |
| 5,236,629 | A | 8/1993 | Mahabadi et al. | 430/137 |
| 5,278,213 | A | 1/1994 | Han et al. | 524/233 |
| 5,573,880 | A | * 11/1996 | Mayama et al. | 430/106.6 |
| 5,935,750 | A | * 8/1999 | Barbetta et al. | 430/106.6 |
| 5,998,076 | A | 12/1999 | Mahabadi et al. | 430/106.6 |
| 6,004,712 | A | 12/1999 | Barbetta et al. | 430/108 |

FOREIGN PATENT DOCUMENTS

| | | | |
|---|---|---|---|
| JP | 58-199356 | * 11/1983 | 430/108 |
| JP | 59-15258 | * 1/1984 | 430/108 |
| JP | 6-273981 | * 9/1994 | 430/108 |

* cited by examiner

*Primary Examiner*—Mark Chapman
(74) *Attorney, Agent, or Firm*—Robert Thompson

(57) ABSTRACT

A carrier containing a core, a polymer coating or mixtures of polymers thereover, and wherein the coating polymer or mixtures contains a conductive polymer.

33 Claims, No Drawings

COATED CARRIERS

RELATED PATENTS AND COPENDING APPLICATIONS

Illustrated in copending application U.S. Ser. No. 037,555 pending, "Carrier", filed Mar. 9, 1998, and U.S. Pat. No. 5,998,076, the disclosures of which are totally incorporated herein by reference is, for example, a carrier comprised of a soft or hard magnetic core, a number of, or all of the pores thereof being filled with polymer and thereover a coating and a carrier comprised of a porous hard magnetic core, and wherein the pores thereof are filled with a polymer and which carrier contains a coating thereover of a polymer, or a polymer mixture. Also, illustrated in U.S. Pat. No. 6,004,712, the disclosure of which is totally incorporated herein by reference, are carriers, coated carriers, and developers thereof. The carrier coatings of the above patent applications may contain a conductive component, such as carbon black therein.

Also of interest is U.S. Ser. No. 09/640,457 now U.S. Pat. No. 6,358,659 "Coated Carriers", filed concurrently herewith, the disclosure of which is totally incorporated herein by reference, where there is illustrated a carrier comprised of a core and thereover a polymer or mixture of polymers, and wherein the polymer contains a conductive inorganic polymer dispersed therein.

The appropriate components of the above patents and copending applications may be selected for the present invention in embodiments thereof.

BACKGROUND OF THE INVENTION

This invention is generally directed to developer compositions, and more specifically, the present invention relates to developer compositions containing carriers. In embodiments of the present invention, the carrier particles can be comprised of a core, a polymer, or mixture of polymer coatings thereover, and which coating or coatings have incorporated therein a polymer, preferably a polyaniline, or a doped conductive polymer wherein the dopant can be a charge transfer agent., such as a sulfate, and wherein the resulting carriers are rendered conductive, for example a carrier conductivity of from about $10^{-6}$ to about $10^{-12}$ ohm-cm)$^{-1}$. The carriers of the present invention may be mixed with a toner of resin, colorant, and optional toner additives to provide developers that can be selected for the development of images in electrostatographic, especially xerographic imaging systems, printing processes and digital systems.

More specifically, examples of conductive polymers that may be selected include polyacetylene, poly(p-phenylene), poly(p-phenylene sulfide), polyvinylenephenylene, poly (vinylene sulfide), polyaniline, polypyrrole, polythiophene and derivatives thereof, and a class of components with conjugated π-electron backbones, which when oxidized or reduced with charge transfer agents, or dopants in suitable amounts of, for example, from about 0.1 to about 20 weight percent, can convert an insulating polymer to a conductive polymer. The electrical conductivity of the conducting polymer is usually measured using a 4-point probe according to ASTM-257, and which conductivity can vary widely depending, for example, primarily on the oxidizing or reducing power of the dopant. Conductivities of about 1,100 (ohm-cm)$^{-1}$ have been reported for polyacetylene, 100 (ohm-cm)$^{-1}$ for polypyrrole and 10 (ohm-cm)$^{-1}$ for polythiophene with $AsF_6^-$ as the dopant ion. Using other doping agents such as $BF_4^-$, $I_2$, $FeCl_4^-$, HCl, $ClO_4^-$, conductivities of from about 500 to about 7,500 (ohm-cm)$^{-1}$ have been reported for polypyrrole, 1,000 (ohm-cm)$^{-1}$ for polythiophene, about 1,000 to about 10,000 (ohm-cm)$^{-1}$ for poly(3-alkylthiophene) and about 200 (ohm-cm)$^{-1}$ for polyaniline, however, many of the commercial polymer materials have conductivities between about $10^{-12}$ and about 100 (ohm-cm)$^{-1}$. Other doping agents include sulfuric acid, methanesulfonic acid, trifluoromethane sulfonic acid, benzenesulfonic acid, p-toluene sulfonic acid, p-ethylbenzene sulfonic acid, 1,3 benzenedisulfonic acid, 2-naphthalene sulfonic acid, 1,5 naphthalene sulfonic acid, and 2-anthraquinone sulfonic acid.

Advantages of the carriers of the present invention in embodiments include, for example, the selection of inherently conductive polymers as carrier coatings wherein the electrical conductivity thereof can be tailored to encompass the range from insulators to semiconductors to metals, and wherein the conductivity can increase linearly with the amount of conductive polymer in the blend. Compatibility of the conductive polymer with the host polymer coating is believed to be more superior than blends with inorganic fillers of conductive additives, or components present in the polymer carrier coating in amounts, for example, of from about 10 to about 70 percent, and preferably from about 20 to about 50 percent by weight of monomer or comonomer mixture. Superior compatibility is achieved with the present invention in embodiments, it is believed, because of the partial miscibility of the conductive polymeric component and the nonconductive polymer hosts, which serve to eliminate the sharp interface between the host polymer and an inorganic filler, which is typically the point of weakest mechanical integrity in the composite, and is the point where the material fractures on the surface of a carrier in a xerographic environment.

PRIOR ART

Developer compositions with coated carriers that contain conductive components like carbon black are known. Disadvantages associated with these prior art carriers may be that the carbon black can increase the brittleness of the polymer matrix, which causes the separation of the coating from the core, and thereby contaminates the toner and developer causing, for example, instabilities in the charging level of the developer as a function of factors, such as the developer age in the xerographic housing and the average toner area coverage of a printed page, or instabilities in the color gamut of the developer set. In addition, with carbon black it is difficult to tune, or preselect the carrier conductivity. These and other disadvantages are avoided, or minimized with the carriers of the present invention in embodiments thereof.

The conductivity of carbon blacks is generally independent of the type of carbon black used and, in composites, there is usually formed a filamentary network above a certain concentration, referred to as the "percolation" threshold. At concentrations of up to about 30 weight percent, conductivities of $10^{-2}$ (ohm-cm)$^{-1}$ have been reported. The resistivity thereof, measured with a standard 4-pin method according to ASTM-257, is observed to increase with decreasing carbon black concentration.

Carrier particles for use in the development of electrostatic latent images are illustrated in many patents including, for example U.S. Pat. No. 3,590,000. These carrier particles may contain various cores, including steel, with a coating thereover of fluoropolymers, or terpolymers of styrene, methacrylate, and silane compounds. Recent efforts have focused on the attainment of coatings for carrier particles, for the purpose of improving development quality; and also to permit carrier particles that can be recycled, and which do not adversely effect the imaging member in any substantial manner. Some of the present commercial coatings can deteriorate, especially when selected for a continuous xerographic process where the entire coating may separate from the carrier core in the form of chips or flakes, and fail upon impact, or abrasive contact with machine parts and other carrier particles. These flakes or chips, which are not generally reclaimed from the developer mixture, have an adverse effect on the triboelectric charging characteristics of the carrier particles thereby providing images with lower resolution in comparison to those compositions wherein entire carrier coatings are retained on the surface of the core substrate. Further, another problem encountered with some prior art carrier coatings resides in fluctuating triboelectric charging characteristics, particularly with changes in relative humidity. The aforementioned modification in triboelectric charging characteristics provides developed images of lower quality, and with background deposits.

There is illustrated in U.S. Pat. No. 4,233,387, the disclosure of which is totally incorporated herein by reference, coated carrier components for electrostatographic developer mixtures comprised of finely divided toner particles clinging to the surface of the carrier particles. Specifically, there is disclosed in this patent coated carrier particles obtained by mixing carrier core particles of an average diameter of from between about 30 microns to about 1,000 microns, with from about 0.05 percent to about 3.0 percent by weight, based on the weight of the coated carrier particles, of thermoplastic resin particles. The resulting mixture is then dry blended until the thermoplastic resin particles adhere to the carrier core by mechanical impaction, and/or electrostatic attraction. Thereafter, the mixture is heated to a temperature of from about 320° F. to about 650° F. for a period of 20 minutes to about 120 minutes, enabling the thermoplastic resin particles to melt and fuse on the carrier core. While the developer and carrier particles prepared in accordance with the process of this patent are suitable for their intended purposes, the conductivity values of the resulting particles are not believed to be constant in all instances, for example, when a change in carrier coating weight is accomplished to achieve a modification of the triboelectric charging characteristics; and further with regard to the '387 patent, in many situations carrier and developer mixtures with only specific triboelectric charging values can be generated when certain conductivity values or characteristics are contemplated. With the invention of the present application, in embodiments thereof the conductivity of the resulting carrier particles are in embodiments substantially constant, and moreover, the triboelectric values can be selected to vary significantly, for example from less than about 80 microcoulombs per gram to greater than about −80 microcoulombs per gram, depending on the polymer mixture selected for affecting the coating processes.

With further reference to the prior art, carriers obtained by applying insulating resinous coatings to porous metallic carrier cores using solution coating techniques are undesirable from many viewpoints. For example, insufficient coating material may be present, and therefore, is not as readily available for triboelectric charging when the coated carrier particles are mixed with finely divided toner particles. Attempts to resolve this problem by increasing the carrier coating weights, for example, to 3 percent or greater to provide a more effective triboelectric coating to the carrier particles necessarily involves handling excessive quantities of solvents, and further usually these processes result in low product yields. Also, solution coated carrier particles when combined and mixed with finely divided toner particles provide in some instances triboelectric charging values which are low for many uses. Powder coating processes have been utilized to overcome these disadvantages, and further to enable developer mixtures that are capable of generating high and useful triboelectric charging values with finely divided toner particles; and also wherein the carrier particles are of substantially constant conductivity. Further, when resin coated carrier particles are prepared by the powder coating process, the majority of the coating materials are fused to the carrier surface thereby reducing the number of toner impaction sites on the carrier material.

Powder coating processes typically require polymers in the form of fine powders which can be mixed and properly coat the carrier core. The triboelectric charging value of the aforementioned carriers can be controlled by the polymer or mixture of polymers selected for the coating. The disadvantage of this approach is that only a limited number of polymers are available in the form of fine powders, especially for the preparation of conductive carriers. Two approaches are known in the prior art for fabricating conductive carriers. First, conductive polymers which are in the form of fine powder can be utilized, for example a conductive carbon black loaded polymer, reference U.S. Pat. No. 5,236,629, the disclosure of which is totally incorporated herein by reference. A second approach is to partially coat the carrier core with polymer. However, coatings prepared by this method have the tendency to chip or flake off, and fail upon impact, or abrasive contact with machine parts and other carrier particles. These flakes or chips, which cannot readily be reclaimed from the developer mixture, have an adverse effect on the triboelectric charging characteristics of the carrier particles, thereby providing images with lower resolution in comparison to those compositions wherein the carrier coatings are retained on the surface of the core substrate. Furthermore, partially coated carriers have a short life, for example from about 1 to about 30 days, and poor stability.

Other patents of interest include U.S. Pat. No. 3,939,086, which illustrates steel carrier beads with polyethylene coatings, see column 6; U.S. Pat. No. 4,264,697, which discloses dry coating and fusing processes; U.S. Pat. Nos. 3,533,835; 3,658,500; 3,798,167; 3,918,968; 3,922,382; 4,238,558; 4,310,611; 4,397,935; 5,015,550; 5,002,846; 4,937,166, and 4,434,220.

Certain ferrite carriers are illustrated in U.S. Pat. Nos. 4,546,060, 4,764,445; 4,855,205, and 4,855,206. In the U.S. Pat. No. 4,855,205 patent there is disclosed a two phase ferrite composite, with a spinel or S phase of the formula $MFe_2O_4$ and a magnetoplumbite or M phase, and which composite and magnetized. It is indicated in column 3 of this patent that the composites can be prepared by conventional procedures and that the composite can be coated with a polymer well known in the art. Examples of polymers include those as illustrated in U.S. Pat. No. 4,546,060, such as fluorocarbon polymers like polytetrafluoroethylene, polyvinylidenefluoride, and the like, see column 8.

The disclosures of each of the above patents are totally incorporated herein by reference. The appropriate carrier cores and polymer coatings of these patents may be selected for the present invention in embodiments thereof.

SUMMARY OF THE INVENTION

It is a feature of the present invention to provide toner and developer compositions with many of the advantages illustrated herein, and which carriers may contain a polymer, or polymer mixture coating and a conductive component of a polyaniline.

In yet another feature of the present invention there are provided polymerization processes for generating carrier particles with substantially preselected constant conductivity parameters, and a wide range of preselected triboelectric charging values.

In yet a further feature of the present invention there are provided conductive carrier particles comprised of a coating generated from a mixture of monomers that, for example, are not in close proximity in the triboelectric series, that is for example, a mixture of monomers from different positions in the triboelectric series and wherein the resulting coating has incorporated therein, or present therein or thereon a conductive polymer, such as a polyaniline, or a doped conductive polymer.

In still a further feature of the present invention there are provided carrier particles with conductive components, for example more conductive than carbon black coated carriers with improved mechanical characteristics, carriers wherein the conductivity thereof is tunable by, for example, adjusting the concentration or amount of conductive polymer selected, and carriers wherein the coating adheres to the core and wherein there is minimal or no separation of the polymer coating from the core.

In yet another feature of the present invention there are provided conductive carrier particles comprised of a metallic or metal oxide core, and which carrier may contain a complete coating thereover generated from a mixture of conductive polymers.

Further, in an additional feature of the present invention there are provided carrier particles with a coating thereover generated from a mixture of polymers and wherein the carrier triboelectric charging values are from about −80 to about 80 microcoulombs per gram at the same coating weight as determined by the known Faraday Cage technique.

Also, in another feature of the present invention there are provided positively charged toner compositions, or negatively charged toner compositions having incorporated therein metal or metal oxide carrier particles with a coating thereover of a polymer, a mixture of polymer coatings thereover, and preferably a mixture of two polymers and which polymers contain a conductive polymer.

Aspects of the present invention relate to carrier comprised of a core, a polymer coating, and wherein the coating contains a conductive polymer; a carrier wherein the polymer coating is comprised of a mixture of polymers; a carrier wherein the mixture is comprised of 2 polymers; a carrier wherein the mixture is comprised of 2 polymers not in close proximity in the triboelectric series; a carrier wherein the mixture is comprised of from about 2 polymers to about 7 polymers; a carrier wherein the conductive polymer is a polyaniline; a carrier wherein the polyaniline possesses a weight average molecular weight $M_w$ of from about 10,000 to about 400,000, or the polyaniline possesses a weight average molecular weight of from about 20,000 to about 100,000; a carrier wherein the polyaniline possesses an $M_w$ of from about 22,000 to about 75,000, and an $M_w/M_n$ ratio of from about 1.4 to about 2; a carrier wherein the conductive polymer is an organic polymer of a polyacetylene, a polypyrrole, a polythiophene, or a poly(p-phenylene sulfide); a carrier wherein the conductive polymer is polyacetylene; a carrier wherein the conductive polymer is present in an amount of from about 5 percent by weight to about 70 percent by weight based on the weight percent of the total of the polymer coating and the conductive polymer; a carrier wherein the conductive polymer is present in an amount of from about 5 percent by weight to about 25 percent by weight, or from about 10 percent by weight to about 20 percent by weight; a carrier wherein the carrier core diameter is from about 30 to about 100 microns; a carrier wherein the core is iron, steel or a ferrite; a carrier wherein the coating polymer is a styrene polymer; a carrier wherein the polymer coating is polyvinylidenefluoride, polyethylene, polymethyl methacrylate, polytrifluoroethylmethacrylate, copolyethylene vinylacetate, copolyvinylidenefluoride, tetrafluoroethylene, polystyrene, tetrafluoro ethylene, polyvinyl chloride, polyvinyl acetate, or mixtures thereof; a carrier wherein the polymer coating is polymethyl methacrylate, polystyrene, polytrifluoroethyl methacrylate, or mixtures thereof; a carrier wherein the polymer coating is comprised of a mixture of polymethyl methacrylate and polytrifluoroethyl methacrylate; a carrier wherein the polymer coating is present in a total amount of from about 0.5 to about 10 percent by weight of the carrier, or from about 1 to about 5 percent by weight of the carrier; a carrier with a conductivity of from about $10^{-15}$ to about $10^{-4}$ $(\text{ohm-cm})^{-1}$; a carrier with a triboelectric charge value of from about −60 to about 60 microcoulombs/gram and a conductivity of from about $10^{-12}$ to about $10^{-6}$ $(\text{ohm-cm})^{-1}$; a process for the preparation of carrier comprised of mixing carrier core with a mixture of monomer, conductive polymer, and initiator, optional chain transfer agent and optional crosslinking agent; polymerizing the monomer by heating thereby resulting in a polymer contained on the carrier core and conductive polymer present in the carrier polymer coating; a process wherein the mixture is heated at a temperature of from about 50° C. to about 95° C., or from about 60° C. to about 85° C., optionally for a period of from about 30 minutes to about 5 hours, or from about 30 minutes to about 3 hours; a process wherein the monomer utilized in the process is selected from the group consisting of styrene, α-methyl styrene, p-chlorostyrene, monocarboxylic acids and derivatives thereof; dicarboxylic acids with a double bond and derivatives thereof; vinyl ketones; vinyl naphthalene; unsaturated mono-olefins; vinylidene halides; N-vinyl compounds; fluorinated vinyl compounds; and mixtures thereof; and wherein the monomer is optionally present in an amount of from about 0.5 to about 10 percent by weight, or from about 1 to about 5 percent by weight of the carrier core; a process wherein the monomer is selected from the group consisting of acrylic acid, methyl acrylate, ethyl acrylate, n-butyl acrylate, isobutyl acrylate, dodecyl acrylate, n-octyl acrylate, 2-chloroethyl acrylate, phenyl acrylate, methylalphachloracrylate, methacrylic acids, methyl methacrylate, ethyl methacrylate, butyl methacrylate, octyl methacrylate, acrylonitrile, methacrylonitrile and acrylamide; maleic acid, monobutyl maleate, dibutyl maleate; vinyl chloride, vinyl bromide, vinyl fluoride, vinyl acetate and vinyl benzoate; vinylidene chloride; pentafluoro styrene, allyl pentafluorobenzene, N-vinyl pyrrole, and trifluoroethyl methacrylate; and mixtures thereof, and wherein the monomer is present in an amount of from about 1 to about 5 percent by weight of the carrier core, or wherein the monomer is methyl methacrylate, styrene, trifluoroethyl methacrylate, or mixtures thereof, and wherein the monomer is present in an amount of from 0.5 to about 10 percent by weight, or from about 1 to about 5 percent by weight of the carrier core and where the amount of the conductive polymer additive present is from about 10 to about 70 percent by weight, or from about 20 to about 50 percent by weight of the monomer mixture, and wherein the initiator is selected from the group consisting of azo compounds, peroxides, and mixtures thereof, and where the amount of the initiator is from about 0.1 to about 20 percent by weight, or from about 0.5 to about 10 percent by weight of the monomer mixture; a process wherein the initiator is selected from the group consisting of 2,2'-azodimethylvaleronitrile, 2,2'-azoisobutyronitrile, azobiscyclohexanenitrile, 2-methylbutyronitrile, benzoyl peroxides, lauryl peroxide, 1-1-(t-butylperoxy)-3,3,5-trimethyl cyclohexane, n-butyl-4,4-di-(t-butylperoxy)valerate, dicumyl peroxide, and mixtures thereof; a developer comprised of the carrier of the present invention and toner; a carrier wherein the polymer coating is an organosiloxane or an organosilane; a developer wherein the toner is comprised of a thermoplastic resin, colorant and optionally toner additives, and wherein the additives are charge additives, wax, surface additives and mixtures thereof; a carrier wherein the conductive polymer contains a dopant; a carrier wherein the dopant is a charge transfer component; a carrier comprised of a core and an organic conductive polymer coating; a carrier wherein there is generated a copolymer of an organic conductive polymer, and a second polymer formed from polymerization of a monomer; carrier comprised of a core, and a polymer coating thereover and which coating contains a conductive polymer therein or thereon, such as polyacetylene, polypyrrole, polyaniline, polythiophene, poly(p-phenylene sulfide, and preferably a polyaniline, and which polymer in embodiments can contain a dopant, such as a known charge transfer component; a conductive coated carrier wherein the core diameter is about 30 to about 100 microns as measured by a Malvern laser diffractometer; a conductive coated carrier wherein the core is iron, steel or a ferrite, such as an iron ferrite, strontium ferrite, and the like; a conductive carrier wherein the coating contains a doped conductive polymer, and a second polymer of, for example, a vinyl polymer or a condensation polymer; a conductive carrier wherein the second polymer coating is a polystyrene, polyvinylidenefluoride, polyethylene, polymethylmethacrylate, polytrifluoroethylmethacrylate, copolyethylene vinylacetate, copolyvinylidenefluoride, tetrafluoroethylene, polystyrene, tetrafluoroethylene, polyvinyl chloride, polyvinyl acetate, polyvinyl acetate, or mixtures thereof, for example from about 1 to about 99 parts of a first coating and from about 99 to about 1 of a second coating, and wherein the total thereof is about 100 percent, or mixtures thereof, and wherein the polymer coating is present in a amount of from about 0.5 to about 99 percent by weight of the carrier; wherein the conductive polymer component is present in an amount of from about 10 to about 70 percent by weight of the polymer coating or polymer coatings; wherein the conductive polymer component is present in an amount of from about 20 to about 50 percent by weight of the polymer coating or polymer coatings; a carrier with a triboelectric charge value of from about −80 to about 80 microcoulombs/gram; carrier with a conductivity of from about $10^{-17}$ to about $10^{-4}$ mho/cm; a carrier with a triboelectric charge value of from about −60 to about 60 microcoulombs/gram and a conductivity of from about $10^{-15}$ to about $10^{-6}$ mho/cm; a process for the preparation of carrier comprised of mixing carrier core with a mixture of monomers and initiator, optional chain transfer agent, and optional crosslinking agent; polymerizing the monomer by heating thereby resulting in a polymer contained on the carrier surface, and thereafter adding a conductive polymer, or wherein the conductive polymer is formed from a conductive monomer; and optionally drying; a process wherein the monomer mixture further contains a conductive monomeric additive; a process wherein the monomer mixture is heated at a temperature from about 50° C. to about 95° C., or from about 60° C. to about 85° C.; a process wherein the monomer mixture is heated for a period of from about 30 minutes to about 5 hours, or from about 30 minutes to about 3 hours; a process wherein the monomer is selected from the group consisting of styrene, α-methyl styrene, p-chlorostyrene, monocarboxylic acids and the derivatives thereof; dicarboxylic acids with a double bond and derivatives thereof; vinyl ketones; vinyl naphthalene; unsaturated mono-olefins; vinylidene halides; N-vinyl compounds; fluorinated vinyl compounds; and mixtures thereof; a process wherein the monomer is selected from the group consisting of acrylic acid, methyl acrylate, ethyl acrylate, n-butyl acrylate, isobutyl acrylate, dodecyl acrylate, n-octyl acrylate, 2-chloroethyl acrylate, phenyl acrylate, methylalphachloracrylate, methacrylic acids, methyl methacrylate, ethyl methacrylate, butyl methacrylate, octyl methacrylate, acrylonitrile, methacrylonitrile and acrylamide; maleic acid, monobutyl maleate, dibutyl maleate; vinyl chloride, vinyl bromide, vinyl fluoride, vinyl acetate and vinyl benzoate; vinylidene chloride; pentafluoro styrene, allyl pentafluorobenzene, N-vinyl pyrrole, and trifluoroethyl methacrylate; and mixtures thereof; a process wherein the monomer is methyl methacrylate, styrene, trifluoroethyl methacrylate, or mixtures thereof, wherein the conductive additive is a polyaniline, and where the amount of the conductive additive present is from about 10 to about 70 percent by weight, or from about 20 to about 50 percent by weight; a process wherein the initiator is selected from the group consisting of azo compounds, peroxides, and mixtures thereof, and where the amount of the initiator is from about 0.1 to about 20 percent by weight, or from about 0.5 to about 10 percent by weight of the monomer mixture; a process wherein the initiator is selected from the group consisting of 2,2'-azodimethylvaleronitrile, 2,2'-azoisobutyronitrile, azobiscyclohexanenitrile, 2-methylbutyronitrile, benzoyl peroxides, lauryl peroxide, 1-1-(t-butylperoxy)-3,3,5-trimethylcyclohexane, n-butyl-4,4-di-(t-butylperoxy) valerate, dicumyl peroxide, and mixtures thereof; a process wherein the crosslinking agent is selected from the group consisting of compounds having two or more polymerizable double bonds, and where the amount of the crosslinking agent is from about 0.1 to about 5 percent by weight, or from about 0.5 to about 3 percent by weight of the monomer mixture; a process wherein the crosslinking agent is selected from the group consisting of divinylbenzene, divinylnaphthalene, ethylene glycol diacrylate, ethylene glycol dimethylacrylate, divinyl ether, divinyl sulfite, divinyl sulfone, and mixtures thereof; a process wherein the chain transfer agent is selected from the group consisting of mercaptans and halogenated hydrocarbons, and wherein the chain transfer agent is selected in an amount of from about 0.01 to about 1 percent by weight, or from about 0.05 to about 0.5 percent by weight of the monomer mixture; a process wherein the chain transfer agent is selected from the group consisting of laurylmercaptan, butylmercaptan carbon tetrachloride, carbon tetrabromide and mixtures thereof; and a developer comprised of conductive carrier particles and toner.

The carrier polymer coating, or polymer coating mixture contains a conductive polymer as illustrated herein, and which conductive polymers are commercially available, it is believed, including, for example, a conductive polyaniline, a doped (or complexed) form of polyaniline with an organic acid, preferably a sulfonic acid; the emeraldine salt of polyaniline, a green-black powder with no odor and commercially available as Versicon from Monsanto Company of St. Louis, Mo., reference U.S. Pat. No. 4,798,685, the disclosure of which is totally incorporated herein by reference; U.S. Pat. No. 5,069,820, the disclosure of which is totally incorporated herein by reference, and U.S. Pat. No. 5,278,213, the disclosure of which is totally incorporated herein by reference, and which illustrates aggregates of small primary particles of an average size of 0.1 to 0.2 micron with a bulk conductivity of 1 to 10 $(\text{ohm-cm})^{-1}$; XICP-OS01, available from Monsanto Company as the soluble form of the emeraldine salt of a polyaniline at a concentration of about 40 to about 60 percent (percent by weight), and typically 50 percent in a mixture of about 27 to about 40 percent of butyl cellusolve and from about 0 to about 33 percent of xylenes. The reported conductivities for the doped or complexed forms of the polyaniline polymer are, for example, 1 $(\text{ohm-cm})^{-1}$ for the volume conductivity and about $10^{-2}$ to about $10^{-3}$ $(\text{ohm-square})^{-1}$ for the surface conductivity as conducted on films with a thickness of 3 mils or approximately 75 microns. Further examples of conductive polymers that may be selected are XICP-OS06 available from Monsanto Company as the soluble form of the emeraldine salt of polyaniline at a concentration of about 9 to about 18 percent, in a mixture of about 50 to about 70 percent of tetrahydrofuran, about 6 to about 14 percent of butyl cellusolve, about 0 to about 11 percent of xylenes, and about 7 to about 14 percent of dopants added to induce conductivity; Conquest XP 1000 a water based dispersion of polypyrrole and polyurethane, available from DSM Research, The Netherlands, with a solids content of 19 to 21 percent and a reported conductivity of higher than about 0.2 $(\text{ohm-cm})^{-1}$; Conquest XP 1020 the dry conductive powder of the aforementioned material with a Minimum Film Forming Temperature (MFT) of 50° C., and a drying temperature being between about 60° C. and about 120° C.; Baytron a dark blue aqueous solution of 3,4-polyethylene dioxythiophene polystyrene sulfonate (PEDT/PSS) containing about 0.5 percent by weight of PEDT and about 0.8 percent by weight of PSS, available from Bayer Corporation, and wherein surface conductivities of $10^{-3}$ to $10^{-5}$ $(\text{ohm-square})^{-1}$ or higher can be achieved with this material; CPUD II an aqueous conductive polyurethane dispersion that can form a conductive film with surface conductivities of $10^{-5}$ to $10^{-8}$ $(\text{ohm})^{-1}$ at a voltage of 100 volts using a Series 900 Megohmer; dispersions of polyaniline in different binders available as Corrpassive lacquer systems, and more specifically, ORMECON™ CSN available as an anticorrosion coating, and wherein the specific conductivity of some highly conductive ORMECON™ lacquers can achieve values of up to 100 $(\text{ohm-cm})^{-1}$; WPPY, available from Eeonyx Corporation, a proprietary composition of polypyrrole in water at a concentration of about 1 to about 6 percent solids and a reported bulk conductivity of about 0.01 to about 0.001 $(\text{ohm-cm})^{-1}$ as measured according to the ASTM F84 and D257; intrinsically conductive polymer additives based on polypyrrole and polyaniline and available as Eeonomer by Eeonyx as thin layers of polypyrrole and polyaniline on the surface of carbon blacks and with conductivities of up to about 40 $(\text{ohm-cm})^{-1}$; and Neste Conductive Polymers—NCP, available from Neste Oy Chemicals, as conductive polymer compositions based on polyaniline that can be solution or melt processed and can achieve conductivities of about 1 $(\text{ohm-cm})^{-1}$.

With further reference to the monomer mixture utilized to achieve the polymer or copolymer coating, close proximity refers to the choice of the polymers selected as dictated by their position in the triboelectric series, therefore for example, one may select a first polymer with a significantly lower triboelectric charging value than the second polymer. For example, the triboelectric charge of a steel carrier core with a polyvinylidenefluoride coating is about −75 microcoulombs per gram. However, the same carrier, with the exception that there is selected a coating of polymethylmethacrylate, has a triboelectric charging value of about 40 microcoulombs per gram. More specifically, not in close proximity refers to first and second polymers that are at different electronic work function values, that is the polymers are not at the same electronic work function value; and further, the first and second polymers are comprised of different components. Additionally, the difference in electronic work functions in embodiment between the first and second polymer is, for example, at least 0.2 electron volt, and preferably is about 2 electron volts; and moreover, it is known that the triboelectric series corresponds to the known electronic work function series for polymers, reference "Electrical Properties of Polymers", Seanor, D. A., Chapter 17, *Polymer Science*, A. D. Jenkins, Editor, North Holland Publishing (1972), the disclosure of which is totally incorporated herein by reference.

The percentage of each polymer present in the carrier coating mixture can vary depending on the specific components selected, the coating weight and the properties desired. Generally, the coated polymer mixtures contain from about 10 to about 90 percent of a first polymer, and from about 90 to about 10 percent by weight of a second polymer. Preferably, there are selected mixtures of polymers with from about 40 to about 60 percent by weight of a first polymer, and from about 60 to about 40 percent by weight of a second polymer.

There results, in accordance with aspects of the present invention, carrier particles of relatively constant conductivities of from about $10^{-15}$ $(\text{ohm-cm})^{-1}$ to about $10^{-4}$ $(\text{ohm-cm})^{-1}$, and preferably from about $10^{-12}$ $(\text{ohm-cm})^{-1}$ to about $10^{-6}$ $(\text{ohm-cm})^{-1}$ at, for example, a 10 volt potential across a 0.1 inch gap containing carrier beads held in place by a magnet; and wherein the carrier particles are of a triboelectric charging value of from about −80 to about 80 microcoulombs per gram, and preferably from about −60 to about 60 microcoulombs per gram as determined by a Faraday Cage, these parameters being dependent on the carrier coatings selected, and the percentage of each of the polymers used, and the conductive polymer.

Various suitable solid core carrier materials can be selected, inclusive of known porous cores. Characteristic core properties of importance include those that will enable the toner particles to acquire a positive or a negative charge, and carrier cores that will permit desirable flow properties in the developer reservoir present in the xerographic imaging apparatus. Also of value with regard to the carrier core properties are, for example, suitable soft magnetic characteristics that permit magnetic brush formation in magnetic brush development processes, and wherein the carrier cores possess desirable aging characteristics. By soft magnetic is meant, for example, a developer that develops an induced magnetic field only when exposed to an external magnetic field, and which field is immediately diminished when the external field is removed. Examples of carrier cores that can be selected include iron, iron alloys, steel, ferrites, magnetites, nickel, and mixtures thereof. Alloys of iron include iron-silicon, ironaluminum-silicon, iron-nickel, iron-cobalt, and mixtures thereof. Ferrites include a class of magnetic oxides that contain iron as the major metallic component and optionally a second metallic component including magnesium, manganese, cobalt, nickel, zinc, copper, and mixtures thereof. Preferred carrier cores include ferrites containing iron, nickel, zinc, copper, manganese, and mixtures thereof, and sponge iron, with a volume average diameter from about 30 to about 100 microns, and preferably from about 30 to about 50 microns as measured by a Malvem laser diffractometer. Examples of monomers or comonomers which can be polymerized to form a polymer coating on the carrier surface in an amount of, for example, from about 0.5 to about 10 percent, and preferably from about 1 to about 5 percent by weight of carrier core include vinyl monomers such. as styrene, p-chlorostyrene, vinyl naphthalene and the like; monocarboxylic acids and their derivatives such as acrylic acid, methyl acrylate, ethyl acrylate, n-butyl acrylate, isobutyl acrylate, dodecyl acrylate, n-octyl acrylate, 2-chloroethyl acrylate, phenyl acrylate, methylalphachloracrylate, methacrylic acids, methyl methacrylate, ethyl methacrylate, butyl methacrylate, octyl methacrylate, acrylonitrile, methacrylonitrile, acrylamide and trifluoroethyl methacrylate, dicarboxylic acids having a double bond and their derivatives such as maleic acid, monobutyl maleate, dibutyl maleate, unsaturated monoolefins such as ethylene, propylene, butylene and isobutylene; vinyl halides such as vinyl chloride, vinyl bromide, vinyl fluoride; vinyl esters such as vinyl acetate, vinyl propionate, vinyl benzoate and vinyl butyrate; vinyl ethers, inclusive of vinyl methyl ether, vinyl isobutyl ether and vinyl ethyl ether; vinyl ketones inclusive of vinyl methyl ketone, vinyl hexyl ketone and methyl isopropenyl ketone; vinylidene halides such as vinylidene chloride and vinylidene chlorofluoride; N-vinyl compounds such as N-vinyl indole and N-vinyl pyrrolidene; fluorinated monomers such as pentafluoro styrene, allyl pentafluorobenzene and the like, other suitable known monomers, and mixtures thereof.

Toners can be admixed with the carrier to generate developers. As one toner resin there can be selected the esterification products of a dicarboxylic acid and a diol comprising a diphenol, reference U.S. Pat. No. 3,590,000 the disclosure of which is totally incorporated herein by reference, reactive extruded polyesters, such as those illustrated in U.S. Pat. No. 5,227,460, the disclosure of which is totally incorporated herein by reference, and the like. Preferred toner resins include styrene/methacrylate copolymers; styrene/butadiene copolymers; polyester resins obtained from the reaction of bisphenol A and propylene oxide; and branched polyester resins resulting from the reaction of dimethylterephthalate, 1,3-butanediol, 1,2-propanediol and pentaerythritol. Other toner resins are illustrated in a number of U.S. patents including some of the patents recited hereinbefore.

Generally, from about 1 part to about 5 parts by weight of toner are mixed with from about 10 to about 300 parts by weight of the carrier particles.

Numerous well known suitable colorants, such as pigments or dyes can be selected as the colorant for the toner including, for example, cyan, magenta, yellow, red, blue, carbon black, nigrosine dye, lamp black, iron oxides, magnetites, and mixtures thereof. The colorant, which is preferably carbon black, should be present in a sufficient amount to render the toner composition highly colored. Thus, the colorant particles can be present in amounts of from about 3 percent by weight to about 20 and preferably from about 3 to about 12 weight percent or percent by weight, based on the total weight of the toner composition, however, lesser or greater amounts of colorant particles can be selected. Colorant includes pigment, dye, mixtures thereof, mixtures of pigments, mixtures of dyes, and the like.

When the colorant particles are comprised of magnetites, which are a mixture of iron oxides ($FeO.Fe_2O_3$) including those commercially available as Mapico Black, they are usually present in the toner composition in an amount of from about 10 percent by weight to about 70 percent by weight, and preferably in an amount of from about 20 percent by weight to about 50 percent by weight.

The resin particles are present in a sufficient, but effective amount, thus when 10 percent by weight of pigment, or colorant such as carbon black is contained therein, about 90 percent by weight of resin is selected. Generally, the toner composition is comprised of from about 85 percent to about 97 percent by weight of toner resin particles, and from about 3 percent by weight to about 15 percent by weight of colorant particles.

The developer compositions can be comprised of thermoplastic resin particles, carrier particles and as colorants, magenta, cyan and/or yellow particles, and mixtures thereof. More specifically, illustrative examples of magentas include 1,9-dimethyl-substituted quinacridone and anthraquinone dye identified in the color index as CI 60720, CI Dispersed Red 15, a diazo dye identified in the color index as CI 26050, CI Solvent Red 19, and the like. Examples of cyans include copper tetra-4(octaecyl sulfonamido) phthalocyanine, X-copper phthalocyanine pigment listed in the color index as CI 74160, CI Pigment Blue, and Anthrathrene Blue, identified in the color index as CI 69810, Special Blue X-2137, and the like; while illustrative examples of yellows are diarylide yellow 3,3-dichlorobenzidene acetoacetanilides, a monoazo pigment identified in the color index as CI 12700, CI Solvent Yellow 16, a nitrophenyl amine sulfonamide identified in the color index as Foron Yellow SE/GLN, CI Dispersed Yellow 33, 2,5-dimethoxy-4-sulfonanilide phenylazo-4'-chloro-2,5-dimethoxy acetoacetanilide, permanent Yellow FGL, and the like. The colorants, which include pigments, mixtures of pigments, dyes, mixtures of dyes, mixtures of dyes and pigments, and the like, are generally present in the toner composition in an amount of from about 1 weight percent to about 15 weight percent based on the weight of the toner resin particles.

For further enhancing the positive charging characteristics of the developer compositions illustrated herein, and as optional components there can be incorporated therein known charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; metal complexes, E-88™, naphthalene sulfonates, quaternary ammonium compounds; and other similar known charge enhancing additives. These additives are usually incorporated into the toner or carrier coating in an amount of from about 0.1 to about 20 percent by weight, and preferably from about 1 to about 7 weight percent by weight.

The toner composition can be prepared by a number of known methods including melt blending the toner resin particles, and pigment particles or colorants of the present invention followed by mechanical attrition. Other methods include emulsion aggregates spray drying, melt dispersion, dispersion polymerization and suspension polymerization. In one dispersion polymerization method, a solvent dispersion of the resin particles and the colorant particles are spray dried under controlled conditions to result in the desired product.

Examples of imaging members selected for the imaging processes illustrated herein are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. Nos. 4,265,990, 4,585,884, 4,584,253, and 4,563,406 the disclosures of which are totally incorporated herein by reference, and other similar layered photoresponsive devices. Examples of generating layers are trigonal selenium, metal phthalocyanines, perylenes, titanyl phthalocyanines, metal free phthalocyanines and vanadyl phthalocyanines. As charge transport molecules there can be selected, for example, the aryl diamines disclosed in the '990 patent. Also, there can be selected as photogenerating pigments, squaraine compounds, thiapyrillium materials hydroxy gallium phthalocyanine, and the like. These layered members are conventionally charged negatively thus usually requiring a positively charged toner. Other photoresponsive members may include pigments of polyvinylcarbazole 4-dimethylamino benzylidene, benzhydrazide; 2-benzylidene-aminocarbazole, 4-dimethamino-benzylidene, (2-nitro-benzylidene)-p-bromoaniline; 2,4-diphenyl-quinazoline; 1,2,4-triazine; 1,5-diphenyl-3-methyl pyrazoline 2-(4'-dimethylaminophenyl)-benzoaxzole; 3-aminocarbazole, polyvinyl carbazole-trinitrofluorenone charge transfer complex; and mixtures thereof.

Moreover, the developer compositions of the present invention are particularly useful in electrostatographic imaging processes and apparatuses wherein there is selected a moving transporting means and a moving charging means; and wherein there is selected a deflected flexible layered imaging member, reference U.S. Pat. Nos. 4,394,429 and 4,368,970, the disclosures of which are totally incorporated herein by reference. Images obtained with the developer composition of the present invention in embodiments possessed acceptable solids, excellent halftones and desirable line resolution with acceptable or substantially no background deposits.

The present invention enables in embodiments carriers with a wide range of triboelectric charging values, selected carrier conductivity, and small carrier size, for example from about 30 to about 100 microns, and preferably from about 30 to about 50 microns in volume average diameter as determined by a Malvern laser diffractometer. Further, when resin coated carrier particles are prepared by the polymerization process of the present invention, the majority, that is, over about 90 percent of the coating materials, such as polymer, or polymers are fused to the carrier surface thereby reducing the number of toner impaction sites on the carrier material. Additionally, there can be achieved with the process of the present invention, independent of one another, desirable triboelectric charging characteristics and conductivity values; that is, for example the triboelectric charging parameter is not primarily dependent on the carrier coating weight as is believed to be the situation with the process of U.S. Pat. No. 4,233,387, wherein an increase in coating weight on the carrier particles may function to also permit an increase in the triboelectric charging characteristics. Specifically, therefore, with the carrier compositions and process of the present invention there can be formulated developers with selected triboelectric charging characteristics and/or conductivity values in a number of different combinations.

Accordingly, for example, there can be formulated in accordance with the invention of the present application carriers with conductivities carrier particles of from about $10^{-15}$ (ohm-cm)$^{-1}$ to about $10^{-4}$ (ohm-cm)$^{-1}$, and preferably from about $10^{-12}$ (ohm-cm)$^{-1}$ to about $10^{-6}$ (ohm-cm)$^{-1}$, as determined in a magnetic brush conducting cell; and triboelectric charging values of from about 80 to about −80 microcoulombs per gram, and preferably from about 60 to about −60 microcoulombs per gram, on the carrier particles as determined by the known Faraday Cage technique. The developers of the present invention can be formulated with constant conductivity values with different triboelectric charging characteristics by, for example, maintaining the same coating weight on the carrier particles and changing the polymer coating ratios. Similarly, there can be formulated developer compositions wherein constant triboelectric charging values are achieved and the conductivities are altered by retaining the polymer ratio coating constant and modifying the coating weight for the carrier particles.

The following Examples are being provided to further illustrate the present invention, it being noted that these Examples are intended to illustrate and not limit the scope of the present invention. Parts and percentages are by weight unless otherwise indicated.

COMPARATIVE SYNTHETIC EXAMPLE I

Synthesis of Poly(Methyl Methacrylate) with Carbon Black (PMMA/CB) as Follows To a 1 liter stainless steel Parr reactor were added 100.9 grams of methyl methacrylate (MMA), 538.2 grams of toluene, 7.23 grams of azobis(cyanohexane) (Vazo-88), 1.69 grams of benzoyl peroxide (Lucidol 75), and 152 grams of Conductex SC Ultra carbon black. The reactor was stirred with a pitch blade impeller at 230 rpm. The temperature was raised to 95° C. and held for 6 hours, followed by a temperature ramp of 0.14° C./minute to 110° C. The reactor was then cooled to room temperature, about 25° C. The reactor contents were poured into a foil tray and toluene was evaporated by air drying. The resulting dry material was ground with a coffee mill, and further dried in a vacuum dryer at 80° C. for 6 hours. The resulting PMMA/CB copolymer, hereafter referred to as SOLP, was in the form of a coarse, sandy powder, which contained 59.6 weight percent of carbon black, 39.8 weight percent of polymer, and 0.6 weight percent of volatiles as measured by thermogravimetric analysis (TGA).

To a 500 milliliters glass reactor were added 95 grams of MMA (methylmethacrylate), 0.6 gram of divinylbenzene and 45 grams of SOLP (from above). This was stirred with a pitch blade impeller at 200 rpm for 15 hours. To this mixture were added 4.1 grams of 2,2'-azobis(2,4-dimethylvaleronitrile) (Vazo-52), 2.1 grams of 2,2'-azobis-2-methyl-butanenitrile (Vazo-67), and 2.9 grams of benzoyl peroxide (Lucidol 75). Stirring was continued at 200 rpm for 2 hours. 150 Grams of this mixture were added to a mixture of 439.6 grams of deionized water, 15.4 grams of polyvinyl alcohol (Airvol 603), and 5 grams of potassium iodide. The mixture was stirred for 2 minutes at 200 rpm with a pitch blade impeller, followed by homogenizing at 800 rpm for 5 minutes with a Brinkmann Polytron. The resulting mixture was charged to a 1 liter Parr reactor and stirred at 230 rpm with a pitch blade impeller. The temperature was raised to 60° C. and held for 1.5 hours, and then raised to 80° C. and held for 1.5 hours. The reactor was then cooled to room temperature. The final slurry was added to a mixture of 406 grams of methanol and 46 grams of deionized water, centrifuged at 3,000 rpm for 3 minutes, and decanted. The resulting wet cake was washed three more times in this manner, followed by a final wash with 900 grams of deionized water. The final wet cake was vacuum dried at 80° C. and then ground with a coffee mill. The final product was a PMMA/CB (polymethyl methacrylate/carbon black) copolymer in the form of a fine talc-like black powder. The composition of this copolymer by TGA was 21.5 weight percent of carbon black, 77.7 weight percent of polymer, and 0.8 weight percent of volatiles.

COMPARATIVE CARRIER EXAMPLE I

A Carrier Coated With Poly(Methyl Methacrylate) and Carbon Black (PMMA/CB) was Prepared as Follows In the first step of the carrier coating process, 2.85 grams of PMMA/CB copolymer prepared in Synthetic Example I and 190 grams of 77 micron volume median diameter irregular steel core (obtained from Hoeganaes), with the core size determined in this and all following carrier Examples by a standard laser diffraction technique, were mixed in a 250 milliliter plastic bottle. The mixing was accomplished with a hand shaker for a period of 45 minutes. There resulted uniformly distributed and electrostatically attached polymer on the core as determined by visual observation. In the second step, the mixture was added to a single-drive batch melt mixing device, a Haake System 90 Torque Rheometer model number 600 (obtained from Haake Buchler Instruments) under the conditions of 5 rpm for a period of 30 minutes at a temperature of 205° C., thereby causing the polymer to melt and fuse to the core. The carrier powder coating process used was described, for example, in U.S. Pat. No. 6,051,354, the disclosure of which is totally incorporated by reference. This resulted in a continuous uniform polymer coating on the core. The final product was comprised of a carrier core with a total of 1.5 percent polymer by weight on the surface, with the weight percent of poly (methyl methacrylate) with carbon black (containing 21.5 weight percent of carbon black and 77.7 weight percent of polymer overall) determined in this and all following carrier Examples by dividing the difference between the weights of the fused carrier and the carrier core by the weight of the fused carrier.

A developer composition was then prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. The toner composition contained as external surface additives 2.5 percent by weight of hydrophobic 40 nanometer size titania, 3.5 percent by weight of 40 nanometer size hydrophobic silica, and 0.3 weight percent of zinc stearate. This developer was conditioned for 18 hours at 50 percent RH. The resulting developer was shaken on a paint shaker, and a 0.3 gram sample was removed after 90 minutes. Thereafter, the triboelectric charge on the carrier particles was determined by the known Faraday Cage process, and there was measured on the carrier a negative charge of 21.0 microcoulombs per gram. Further, the conductivity of the carrier as determined by forming a 0.1 inch ion magnetic brush of the carrier particles, and measuring the conductivity by imposing a 10 volt potential across the brush was $7.4\times10^{-7}$ $(\text{ohm-cm})^{-1}$. Therefore, these carrier particles were conductive.

SYNTHETIC EXAMPLE I

Synthesis of a Composite Poly(Methyl Methacrylate) with Polyaniline Conductive Polymer as Follows To a 1 liter stainless steel Parr reactor were added 90.8 grams of methyl methacrylate (MMA), 490 grams of toluene, 6.5 grams of azobis(cyanohexane) (Vazo-88), 1.69 grams of benzoyl peroxide (Lucidol 75), and 68.4 grams of Versicon conductive polymer powder purchased from Monsanto Corporation. The reactor was stirred with a pitch blade impeller at 230 rpm. The temperature was raised to 95° C. and held for 6 hours, followed by a temperature ramp of 0.14° C./minute to 110° C. The reactor was then cooled to room temperature. The reactor contents were poured into a foil tray and toluene was evaporated by air drying. The resulting dry material was ground with a coffee mill, and further dried in a vacuum dryer at 80° C. for 6 hours. The resulting PMMA/polyaniline copolymer, was in the form of a coarse, sandy powder. The powder contained approximately 43 weight percent of conductive polyaniline polymer, 57 weight percent of insulating PMMA (polymethylmethacrylate) polymer, and 0.2 weight percent of volatiles as measured by thermogravimetric analysis (TGA).

The conductivity of this material measured by pressing a 1.275 centimeter diameter pellet comprised of approximately 1 gram of the material using a pressure of 20,000 psi, clamping the pellet between two electrodes, and measuring the current flowing at an applied DC voltage of 10 volts was $1.46\times10^{-4}$ $(\text{ohm-cm})^{-1}$.

SYNTHETIC EXAMPLE II

To a 500 milliliters glass reactor were added 124.0 grams of MMA, 0.6 gram of divinylbenzene and 59.2 grams of the PMMA/polyaniline copolymer of Synthetic Example I. This mixture was stirred with a pitch blade impeller at 200 rpm for 15 hours. To this mixture were added 5.35 grams of 2,2'-azobis(2,4-dimethylvaleronitrile) (Vazo-52), 2.67 grams of 2,2'-azobis-2-methyl-butanenitrile (Vazo-67), and 3.49 grams of benzoyl peroxide (Lucidol 75). Stirring was continued at 200 rpm for 2 hours. 150 Grams of this mixture were added to a mixture of 439.6 grams of deionized water, 15.4 grams of polyvinyl alcohol (Airvol 603), and 5 grams of potassium iodide. The mixture was stirred for 2 minutes at 200 rpm with a pitch blade impeller, followed by homogenizing at 800 rpm for 5 minutes with a Brinkmann Polytron. The resulting mixture was charged to a 1 liter Parr reactor and stirred at 230 rpm with a pitch blade impeller. The temperature was raised to 60° C. and held for 1.5 hours, and then raised to 80° C. and held for 1.5 hours. The reactor was then cooled to room temperature. The final slurry was added to a mixture of 406 grams of methanol and 46 grams of deionized water, centrifuged at 3,000 rpm for 3 minutes, and decanted. The wet cake was washed three more times in this manner, followed by a final wash with 900 grams of deionized water. The final wet cake was vacuum dried at 80° C. and then ground with a coffee mill. The final product was comprised of a PMMA/ICP (ICP refers to Inherently Conductive Polymers) composite in the form of a fine talc-like grey powder. The composition of the composite by TGA was approximately 13.8 weight percent of conductive polyaniline polymer, and 86.2 weight percent of PMMA insulating polymer.

SYNTHETIC EXAMPLE III

Synthesis of Composite of Poly(Methyl Methacrylate) with Conductive Polyaniline Polymer as Follows To a 1 liter stainless steel Parr reactor were added 90.8 grams of methyl methacrylate (MMA), 421.6 grams of toluene, 6.5 grams of azobis(cyanohexane) (Vazo-88), 1.69 grams of benzoyl peroxide (Lucidol 75), and 136.8 grams of XICP-OS01 conductive polymer solution purchased from Monsanto Corporation. The XICP-OS01 solution was believed to contain 40 percent of active ingredient. The reactor was stirred with a pitch blade impeller at 230 rpm. The temperature was raised to 95° C. and held for 6 hours, followed by a temperature ramp of 0.14° C./minute to 110° C. The reactor was then cooled to room temperature. The reactor contents were poured into a foil tray and toluene was evaporated by air drying. The resulting dry material was ground with a coffee mill, and further dried in a vacuum dryer at 80° C. for 6 hours. The resulting PMMA/polyaniline copolymer was in the form of a coarse, sandy powder. The powder contained approximately 37.6 weight percent of conductive polyaniline polymer and 62.4 weight percent of PMMA insulating polymer measured by thermogravimetric analysis (TGA).

The conductivity of this material, as measured by the technique described in Example III, was $5.92\times10^{-10}$ (ohm-cm)$^{-1}$.

SYNTHETIC EXAMPLE IV

To a 500 milliliter glass reactor were added 124 grams of MMA, 0.6 gram of divinylbenzene and 59.2 grams of the conductive PMMA/polyaniline copolymer of Synthetic Example III. This was stirred with a pitch blade impeller at 200 rpm for 15 hours. To this mixture were added 5.35 grams of 2,2'-azobis(2,4-dimethylvaleronitrile) (Vazo-52), 2.67 grams of 2,2'-azobis-2-methyl-butanenitrile (Vazo-67), and 3.49 grams of benzoyl peroxide (Lucidol 75). Stirring was continued at 200 rpm for 2 hours. 150 Grams of this mixture were added to a mixture of 439.6 grams of deionized water, 15.4 grams of polyvinyl alcohol (Airvol 603), and 5 grams of potassium iodide. The mixture was stirred for 2 minutes at 200 rpm with a pitch blade impeller, followed by homogenizing at 800 rpm for 5 minutes with a Brinkmann Polytron. The resulting mixture was charged to a 1 liter Parr reactor and stirred at 230 rpm with a pitch blade impeller. The temperature was raised to 60° C. and held for 1.5 hours, and then raised to 80° C. and held for 1.5 hours. The reactor was then cooled to room temperature. The final slurry was added to a mixture of 406 grams of methanol and 46 grams of deionized water, centrifuged at 3,000 rpm for 3 minutes, and decanted. The wet cake was washed three more times in this manner, followed by a final wash with 900 grams of deionized water. The final wet cake was vacuum dried at 80° C. and then ground with a coffee mill. The final product was a PMMA/ICP the above PMMA/polyaniline copolymer in the form of a fine talc-like grey powder. The composition of this copolymer by TGA was approximately 12.2 weight percent of the conductive polymer and 87.8 weight percent of insulating polymer.

CARRIER EXAMPLE I

A Carrier Coated with Poly(Methyl Methacrylate) with Conductive Polymer Composite was Prepared as Follows In the first step of the carrier coating process, 2.85 grams of the composite prepared in Synthetic Example IV and 190 grams of 77 micron volume median diameter irregular steel core (obtained from Hoeganaes), with the core size determined in this and all following carrier Examples by a standard laser diffraction technique, were mixed in a 250 milliliter plastic bottle. The mixing was accomplished with a hand shaker for a period of 45 minutes. There resulted uniformly distributed and electrostatically attached polymer on the core as determined by visual observation. In the second step, the mixture was added to a single-drive batch melt mixing device (obtained from Haake) under the conditions of 5 rpm for a period of 30 minutes at a temperature of 205° C., thereby causing the polymer to melt and fuse to the core. This resulted in a continuous uniform polymer coating on the core. The final product was comprised of a carrier core with a total of 1.5 percent polymer by weight on the surface with the weight percent of poly(methyl methacrylate) with carbon black (containing 12.2 weight percent of XICPOS01 and 87.8 weight percent of polymer overall) determined in this and all following carrier Examples by dividing the difference between the weights of the fused carrier and the carrier core by the weight of the fused carrier.

A developer composition was then prepared with this carrier as described in Carrier Example I. The resulting developer was shaken on a paint shaker, and a 0.3 gram sample was removed after 15 minutes. Thereafter, the triboelectric charge on the carrier particles was determined by the known Faraday Cage process, and there was measured on the carrier a charge of 42.5 microcoulombs per gram. A 0.3 gram sample was removed after 90 minutes. Thereafter, the triboelectric charge on the carrier particles was determined by the known Faraday Cage process, and there was measured on the carrier a charge of 52.5 microcoulombs per gram. Further, the conductivity of the carrier measured as described in Example III was $2.5\times10^{-12}$ (ohm-cm)$^{-1}$.

CARRIER EXAMPLE II

8 Grams of the carrier material prepared in Carrier Example I were mixed with 0.8 gram of p-toluenesulfonic acid monohydrate (CAS 6192-52-5) in 15 grams of methanol (CAS 67-56-1). The mixture was lightly stirred for 10 minutes and allowed to dry. The carrier conductivity measured as described in Example III was $6.8\times10^{-11}$ (ohm-cm)$^{-1}$.

CARRIER EXAMPLE III

8 Grams of the carrier material prepared in Carrier Example I were mixed with 0.8 gram of p-toluenesulfonic acid monohydrate (CAS 25155-30-0) in 15 grams of methanol (CAS 67-56-1). The mixture was lightly stirred for 10 minutes and allowed to dry. The carrier conductivity measured as described in Carrier Example III was $8.1\times10^{-9}$ (ohm-cm)$^{-1}$.

CARRIER EXAMPLE IV

8 Grams of the carrier material prepared in Carrier Example I were mixed with 0.8 gram of p-toluenesulfonic acid monohydrate (CAS 6192-52-5) in 15 grams of methanol (CAS 67-56-1). The mixture was lightly stirred for 10 minutes and allowed to dry. The carrier conductivity measured as described in Carrier Example III was $5.6\times10^{-9}$ (ohm-cm)$^{-1}$.

CARRIER EXAMPLE V

Two hundred grams of Nuclear Metals C-1018 steel 100 micron diameter carrier core particles were preheated in an oven to 80° C. 7.5 Grams of polyaniline solution XICP-OS01, available from Monsanto Chemicals, were then added to the hot core with stirring until the solvent had evaporated. The resulting mixture was then dispersed on a tray and dried in an oven overnight.

A xerographic developer composition was was then prepared by adding 1 gram of a 9 micron volume median diameter toner composition to 24 grams of the above coated carrier. The toner composition was comprised of a 30 percent by weight gel content of a partially crosslinked polyester resin, reference U.S. Pat. No. 5,376,494, the disclosure of which is totally incorporated herein by reference, obtained by the reactive extrusion of a linear bisphenol A propylene oxide fumarate polymer and 5 weight percent of carbon black pigment, and incorporating 4 percent of wax. The toner also contained 0.4 weight percent of Cabot TS530 external silica additive, comprised of a 7 nanometer primary size silica core coated by treatment with hexamethyldisilazane. The developer composition was then conditioned overnight at 50 percent relative humidity, and was subsequently charged on a paint shaker. The carrier charge was determined after 15 minutes and after 90 minutes of charging to primarily determine the stability of the charge to very aggressive mixing using the known Faraday Cage process. There was measured on the carrier a positive charge of 25.8 microcoulombs per gram after 15 minutes of mixing and 22.6 microcoulombs per gram after 90 minutes of mixing. Further, the conductivity of the carrier, as determined by forming 0.1 inch long magnetic brush off carrier particles, and measuring the conductivity by imposing a 10 volt potential across the brush, was $1.2\times10^{-7}$ (ohm-cm)$^{-1}$.

CARRIER EXAMPLE VI

Two hundred grams of Nuclear Metals C-1018 steel 100 micron diameter carrier core particles were preheated in an oven to 80° C. 7.5 Grams of polyaniline solution XICP-OS06, obtained from Monsanto, were then added to the hot core with stirring until the solvent had evaporated. The resulting mixture was then dispersed on a tray and dried in an oven overnight. The xerographic developer prepared as in Example XI had a conductivity across the brush of $2.5\times10^{-10}$ (ohm-cm)$^{-1}$.

For the above Examples the triboelectric values and other values were determined subsequent to the preparation of a developer as indicated herein, reference for example Example I.

Other modifications of the present invention may occur to those skilled in the art subsequent to a review of the present application. The aforementioned modifications, including equivalents thereof, are intended to be included within the scope of the present invention.

What is claimed is:

1. Carrier comprised of a core, a polymer coating, and wherein said coating contains a conductive polymer and wherein said conductive polymer is an organic polymer of a polyacetylene, a polypyrrole, a polythiophene, or a poly(p-phenylene sulfide) or a polyaniline, wherein said carrier possesses a conductivity of from about $10^{-15}$ to about $10^{-4}$ (ohm-cm)$^{-1}$ and wherein the mixture is comprised of from about 2 polymers to about 7 polymers.

2. A carrier in accordance with claim 1 wherein the polymer coating is comprised of a mixture of polymers.

3. A carrier in accordance with claim 2 wherein the mixture is comprised of 2 polymers.

4. A carrier in accordance with claim 2 wherein the mixture is comprised of 2 polymers not in close proximity in the triboelectric series.

5. A carrier in accordance with claim 2 with a conductivity of from about $10^{-15}$ to about $10^{-4}$ (ohm-cm)$^{-1}$.

6. A carrier in accordance with claim 2 with a triboelectric charge value of from about −60 to about 60 microcoulombs/gram and a conductivity of from about $10^{-12}$ to about $10^{-6}$ (ohm-cm)$^{-1}$.

7. A carrier in accordance with claim 1 wherein the polyaniline possesses a weight average molecular weight $M_w$ of from about 10,000 to about 400,000, or said polyaniline possesses a weight average molecular weight of from about 20,000 to about 100,000.

8. A carrier in accordance with claim 1 wherein said polyaniline possesses an $M_w$ of from about 22,000 to about 75,000, and an $M_w/M_n$ ratio of from about 1.4 to about 2.

9. A carrier in accordance with claim 1 wherein said conductive polymer is an organic polymer of a polyacetylene, a polypyrrole, a polythiophene, or a poly(p-phenylene sulfide).

10. A carrier in accordance with claim 1 wherein the conductive polymer is polyacetylene.

11. A carrier in accordance with claim 1 wherein said conductive polymer is present in an amount of from about 5 percent by weight to about 70 percent by weight based on the weight percent of the total of said polymer coating and said conductive polymer.

12. A carrier in accordance with claim 1 wherein said conductive polymer is present in an amount of from about 5 percent by weight to about 25 percent by weight, or from about 10 percent by weight to about 20 percent by weight.

13. A carrier in accordance with claim 1 wherein said core diameter is from about 30 to about 100 microns.

14. A carrier in accordance with claim 1 wherein said core is iron, steel or a ferrite.

15. A carrier in accordance with claim 1 wherein said coating polymer is a styrene polymer.

16. A carrier in accordance with claim 1 wherein said polymer coating is polyvinylidenefluoride, polyethylene, polymethyl methacrylate, polytrifluoroethylmethacrylate, copolyethylene vinylacetate, copolyvinylidenefluoride, tetrafluoroethylene, polystyrene, tetrafluoro ethylene, polyvinyl chloride, polyvinyl acetate, or mixtures thereof.

17. A carrier in accordance with claim 1 wherein said polymer coating is polymethyl methacrylate, polystyrene, polytrifluoroethyl methacrylate, or mixtures thereof.

18. A carrier in accordance with claim 1 wherein said polymer coating is comprised of a mixture of polymethyl methacrylate and polytrifluoroethyl methacrylate.

19. A carrier in accordance with claim 1 wherein said polymer coating is present in a total amount of from about 0.5 to about 10 percent by weight of said carrier, or from about 1 to about 5 percent by weight of said carrier.

20. A developer comprised of the carrier of claim 1 and toner.

21. A developer in accordance with claim 20 wherein said toner is comprised of a thermoplastic resin, colorant and optionally toner additives, and wherein said additives are charge additives, wax, surface additives and mixtures thereof.

22. A carrier in accordance with claim 1 wherein said polymer coating is an organosiloxane or an organosilane.

23. A carrier in accordance with claim 1 wherein the conductive polymer contains a dopant.

24. A carrier in accordance with claim 23 wherein the dopant is a charge transfer component.

25. Carrier in accordance with claim 1 wherein said conductive polymer is a complex of a polyaniline which complex is formed with an organic acid, and the emeraldine salt of polyaniline.

26. A process for the preparation of carrier comprised of mixing carrier core with a mixture of monomer, conductive polymer, and initiator, optional chain transfer agent and optional crosslinking agent; polymerizing the monomer by heating thereby resulting in a polymer contained on the carrier core and conductive polymer present in the carrier polymer coating and wherein said conductive polymer is an organic polymer of a polyacetylene, a polypyrrole, a polythiophene, a poly(p-phenylene sulfide) or a polyaniline and wherein said carrier possesses a conductivity of from about $10^{-15}$ to about $10^{-4}$ (ohm-cm)$^{-1}$.

27. A process in accordance with claim 26 wherein the mixture is heated at a temperature of from about 50° C. to about 95° C., or from about 60° C. to about 85° C., optionally for a period of from about 30 minutes to about 5 hours, or from about 30 minutes to about 3 hours.

28. A process in accordance with claim 26 wherein the monomer is selected from the group consisting of styrene, α-methyl styrene, p-chlorostyrene, monocarboxylic acids and derivatives thereof; dicarboxylic acids with a double bond and derivatives thereof; vinyl ketones; vinyl naphthalene; unsaturated mono-olefins; vinylidene halides; N-vinyl compounds; fluorinated vinyl compounds; and mixtures thereof; and wherein said monomer is optionally present in an amount of from about 0.5 to about 10 percent by weight, or from about 1 to about 5 percent by weight of said carrier core.

29. A process in accordance with claim 26 wherein the monomer is selected from the group consisting of acrylic acid, methyl acrylate, ethyl acrylate, n-butyl acrylate, isobutyl acrylate, dodecyl acrylate, n-octyl acrylate, 2-chloroethyl acrylate, phenyl acrylate, methylalphachloracrylate, methacrylic acids, methyl methacrylate, ethyl methacrylate, butyl methacrylate, octyl methacrylate, acrylonitrile, methacrylonitrile and acrylamide; maleic acid, monobutyl maleate, dibutyl maleate; vinyl chloride, vinyl bromide, vinyl fluoride, vinyl acetate and vinyl benzoate; vinylidene chloride; pentafluoro styrene, allyl pentafluorobenzene, N-vinyl pyrrole, and trifluoroethyl methacrylate; and mixtures thereof; and wherein said monomer is present in an amount of from about 1 to about 5 percent by weight of said carrier core, or wherein the monomer is methyl methacrylate, styrene, trifluoroethyl methacrylate, or mixtures thereof, and wherein said monomer is present in an amount of from 0.5 to about 10 percent by weight, or from about 1 to about 5 percent by weight of said carrier core and where the amount of said conductive polymer additive present is from about 10 to about 70 percent by weight, or from about 20 to about 50 percent by weight of said monomer mixture, and wherein the initiator is selected from the group consisting of azo compounds, peroxides, and mixtures thereof, and where the amount of said initiator is from about 0.1 to about 20 percent by weight, or from about 0.5 to about 10 percent by weight of said monomer mixture.

30. A process in accordance with claim 26 wherein the initiator is selected from the group consisting of 2,2'-azodimethylvaleronitrile, 2,2'-azoisobutyronitrile, azobiscyclohexanenitrile, 2-methylbutyronitrile, benzoyl peroxides, lauryl peroxide, 1-1-(t-butylperoxy)-3,3,5-trimethyl cyclohexane, n-butyl-4,4-di-(t-butylperoxy) valerate, dicumyl peroxide, and mixtures thereof.

31. A carrier comprised of a core, a polymer coating, and wherein said coating contains a conductive polymer and wherein said conductive polymer is polyacetylene, poly(p-phenylene), poly(p-phenylene sulfide), polyvinylenephenylene, poly(vinylene sulfide), polyaniline, polypyrrole, polythiophene or derivatives thereof or with components with conjugated π electron backbones which when oxidized or reduced convert an insulating polymer to a conductive polymer.

32. A carrier in accordance with claim 31 wherein said conductive polymer is a polyaniline.

33. A carrier in accordance with claim 31 wherein the conductivity of said carrier is from about $10^{-12}$ to $10^{-6}$ (ohm-cm)$^{-1}$.

* * * * *